US006041753A

United States Patent [19]

Lin et al.

[11] Patent Number: 6,041,753

[45] Date of Patent: Mar. 28, 2000

[54] INTAKE SWIRL ENHANCING STRUCTURE FOR INTERNAL COMBUSTION ENGINE

[75] Inventors: Shyh-Shyan Lin; Jyh-Chyang Yang, both of Taipei, Taiwan

[73] Assignees: Industrial Technology Research Institute, China Motor Corporation; Yulon Motor Co., Ltd., and Sanyang Industry Co., Ltd., both of Taiwan

[21] Appl. No.: 09/095,950

[22] Filed: Jun. 11, 1998

[51] Int. Cl.[7] ..... F02M 29/04

[52] U.S. Cl. ..... 123/306; 123/590; 123/593

[58] Field of Search ..... 123/306, 590, 123/592, 593

[56] References Cited

U.S. PATENT DOCUMENTS

| | | | |
|---|---|---|---|
| 1,969,202 | 7/1934 | Bugaud | 123/306 |
| 4,515,138 | 5/1985 | Agadi | 123/590 |
| 5,113,838 | 5/1992 | Kim | 123/593 |
| 5,595,157 | 1/1997 | Siew et al. | 123/306 |
| 5,685,281 | 11/1997 | Li | 123/590 |

*Primary Examiner*—Willis R. Wolfe
*Assistant Examiner*—Hieu T. Vo
*Attorney, Agent, or Firm*—Bacon & Thomas PLLC

[57] ABSTRACT

Disclosed is an intake swirl enhancing structure for internal combustion engine mainly including a guide shaft and several guide interfaces radially extending from the guide shaft to split a space into several intake passages. Each of the guide interfaces has a curved outer corner near an outlet end of the intake passages to swirl gas flowing through and out each intake passage, so that the gas enters a cylinder of the engine and forms a turbulent swirl in the cylinder. The intake swirl enhancing structure may be directly set in an intake manifold or an intake port for use without the need of modifying the existing engine design. Enhanced swirls produced by the intake swirl enhancing structure result in faster and steadier burning of mixture in the engine. When the structure is employed in the lean mixture burning, reduced fuel consumption and minimized environmental pollution can be achieved.

12 Claims, 5 Drawing Sheets

Fig.4

| | |
|---|---|
| Type of engine | Four-stroke engine |
| Bore diameter x stroke | 68.7 x 74.5 |
| Total displacement | 1200 c.c. |
| Compression ratio | 9.5 |
| Cam shaft | Single overhead cam |
| Max. valve stroke | 9.0 mm |
| Injection system | MPFI |

BASIC SPECS OF TESTED ENGINE

Fig.5

| | Cf | Swirl ratio | Tumble ratio |
|---|---|---|---|
| SGS-2 | 0.29 | 0.7 | 0.1 |
| SGS-3 | 0.31 | 0.07 | 0.2 |

INTAKE FLOW CONDITIONS OF TESTED ENGINES

Fig.6

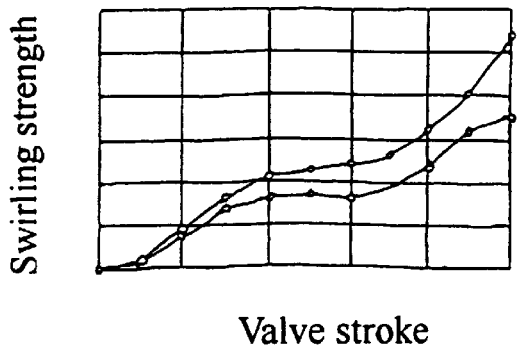

INTAKE SWIRLING STRENGTHS OF ENGINE BEFORE AND AFTER MOUNTING INTAKE SWIRL ENHANCING STRUCTURE

IGNITION DELAYS OF FULL-LOADED ENGINE AT DIFFERENT SWIRLING STRENGTHS

Results from 5-90% burning time of full-loaded engine at different swirling stregths Relations between cyclic variation of IMEP and air-fuel ratio found from engine at different swirling strengths Cyclic variations of IMEP of full-loaded engine at different swirling strengths

INTAKE SWIRL ENHANCING STRUCTURE FOR INTERNAL COMBUSTION ENGINE

FIELD OF THE INVENTION

The present invention relates to an intake swirl enhancing structure for internal combustion engine, and more particularly to an intake swirling structure which has simple structure and can be conveniently installed in an internal combustion engine for use while directly, economically, safely, and effectively improving the combustion of mixture in the internal combustion engine to effectively reduce fuel consumption and minimize environmental pollution.

DESCRIPTION OF THE PRIOR ART

Energies and environmental protection are critical issues in all countries in the world. Automobiles and motorcycles are products that are very important transportation vehicles in our daily life on the one hand and consume energies and produce exhaust to danger our environment on the other hand. It has become a common target of many automobile and motorcycle manufacturers to effectively reduce fuel consumption and environmental pollution caused by exhaust from automobiles and motorcycles. To enable the currently employed internal combustion engines to meet this requirement, the "lean mixture combustion" technique has been adopted. According to this technique, enhanced in-cylinder turbulence, that is, intake swirl and intake tumble, must be induced into the cylinder for the engine operation to maintain steady combustion even with lean mixture. Currently, there are two major ways to practice the above technique. In the first way, a multi-valve system is used in the internal combustion engine. By closing one of the valves or using other secondary ports, intake swirls are generated. In the second way, the intake port of a one-valve intake system is modified to generate intake swirls. In both ways, the cylinder head must be largely modified to alter its existing design for installation of a swirl control valve or addition of secondary intake ports. Accordingly, increased manufacturing cost is required. Moreover, the installation of the swirl control valve or the addition of intake ports requires longer mounting time and qualified professionals or skilled workers that form another costs of users.

It is therefore tried by the inventor to develop a structure for producing enhanced intake swirls in an internal combustion engine to eliminate the above-mentioned drawbacks existing in the conventional ways of producing intake swirls.

SUMMARY OF THE INVENTION

A primary object of the present invention is to provide an intake swirl enhancing structure which can be directly installed in an intake manifold or an intake port of a one-valve intake system without verifying the original design of the cylinder port while enhanced intake swirls can be achieved without adversely affecting the flow of intake. Alternatively, in a multi-valve system, the intake swirl enhancing structure of the present invention can be installed in the cylinder port to enhance intake swirls without the need of closing other intake valves or using secondary ports. Through the achievement of the above object of the present invention, following advantages can be found:

1. The structure according to the present invention has simple structure and can be easily installed to directly enhance intake swirls and fuel combustion in the internal combustion engine while efficiently reduces fuel consumption and environmental pollution. No other complicate engine control system and control logic or new engine design or large modification of engine design is required.

2. The structure according to the present invention results in an increased intake swirl ratio for the internal combustion engine to have a shortened time of ignition delay, and for the fuel to burn more steadily at a higher speed to allow higher lean limit for the engine. This will not only improve the performance of the engine at middle to low load, but also reduce fuel consumption and environmental pollution because the engine may operate at a lower fuel-air ratio (or a higher lean limit) condition.
3. The structure according to the present invention is directly mounted in the intake passage of the engine. The unique uniform division of space provided by the structure forms multiple guide interfaces having curved outer corners near outlet end of the intake passage, so that mixture is guided into the cylinder of the engine in swirls and keeps swirling in the cylinder about the central axis of the cylinder during the compression stroke. Therefore, enhanced swirls can be steadily produced in the cylinder.

BRIEF DESCRIPTION OF THE DRAWINGS

A more complete understanding of these and other features and advantages of the present invention will become apparent from a careful consideration of the following detailed description of certain embodiments illustrated in the accompanying drawings, wherein:

FIG. 4 is a table showing basic specifications of a tested engine;

FIG. 5 is a table comparing the intake flow conditions of the tested engine before and after mounting the present invention;

FIG. 6 is a graph showing the intake swirling strengths of the tested engine before and after mounting the present invention;

DETAILED DESCRIPTION OF THE PREFERRED EMBODIMENTS

Figure 1A:
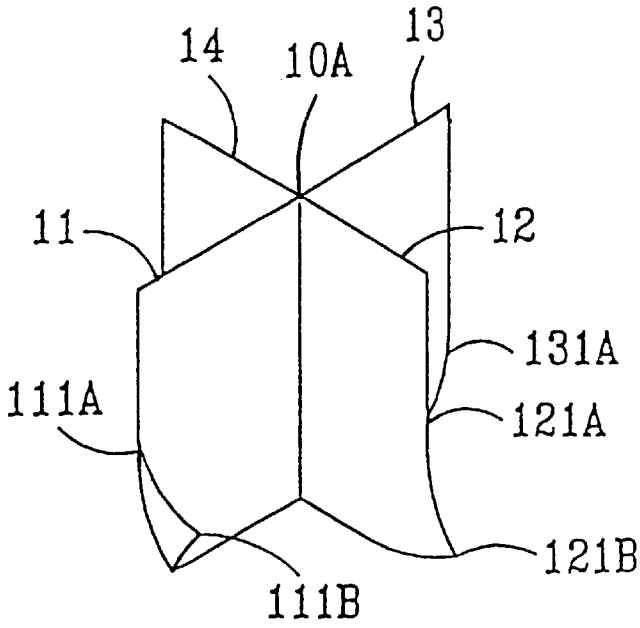
FIG. 1A illustrates an intake swirl enhancing structure according to a preferred embodiment of the present invention.
Figure 1B:
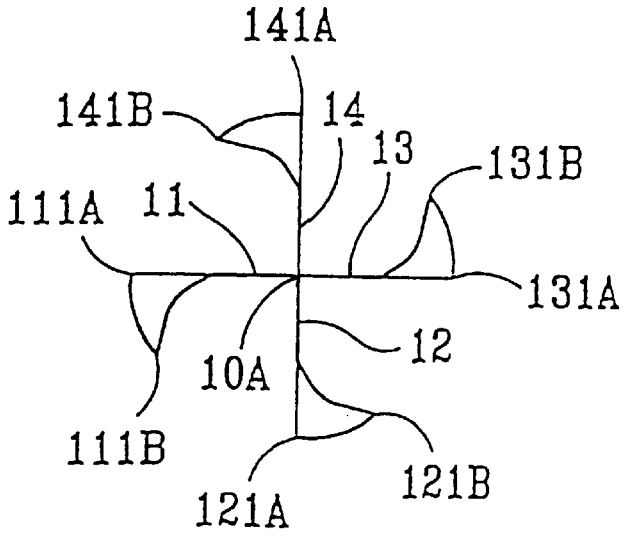
FIG. 1B is a top view of the intake swirl enhancing structure of FIG. 1A.

Please refer to FIGS. 1A and 1B which are perspective and top view, respectively, of an intake swirl enhancing structure 10 according to a preferred embodiment of the present invention. In this embodiment, the intake swirl enhancing structure 10 includes a guide shaft 10A and multiple guide interfaces 11, 12, 13, 14 that radially extend from the shaft 10A and divide a space around the shaft 10A into multiple intake passages. The guide interfaces 11, 12, 13, and 14 are so formed that they respectively have an arcuated guide surface portion 111, 121, 131, and 141 at their outer corner near an outlet end of the intake passages.

With these arcuated guide surface portions 111, 121, 131 and 141 on the guide interfaces 11, 12, 13 and 14, mixture of fuel and air flowing through each intake passage is swirled into a cylinder of an engine in which the structure 10 is mounted. The flows of swirling mixture form a combined turbulence or swirl. The guide interfaces 11, 12, 13, 14 have vertical straight outer edges respectively extending from an outer corner of the guide interfaces near an inlet end of the intake passages to a point 111A, 121A, 131A, 141A at where the arcuated guide surface portion starts to curve. The intake swirl enhancing structure can be set in an intake port 20A of the engine with the straight outer edges of the guide interfaces 11, 12, 13, 14 frictionaly contacting with an inner wall surface 20 of the intake port, because an acceptable dimensional tolerance exists between an overall diameter of the intake swirl enhancing structure 10 defined by the straight outer edges of the radially extended guide interfaces 11, 12, 13, 14 and an inner diameter of the intake port 20A. In a variation of the above embodiment, the straight outer edges of the guide interfaces extend inward from the inlet end to the outlet end to form convergent and inclined edges, so that the intake swirl enhancing structure 10 may be directly installed in a conventional reverse conic intake pipe. As shown in FIG. 1B, the outlet end outer corners of the guide interfaces 11, 12, 13, and 14 are so curved that four ending points 111B, 121B, 131B, and 141B and outer surfaces of the arcuated guide surface portions locate on the same one circle. In brief, the intake swirl enhancing structure 10 of the present invention has an inlet end that divides a space in an intake pipe into multiple (four are shown in FIGS. 1A and 1B) sectors of gas passages and has an outlet end forming multiple (four in FIGS. 1A and 1B) arcuated guide surface portions for compressing and swirling gas passing therethrough.

Figure 2:
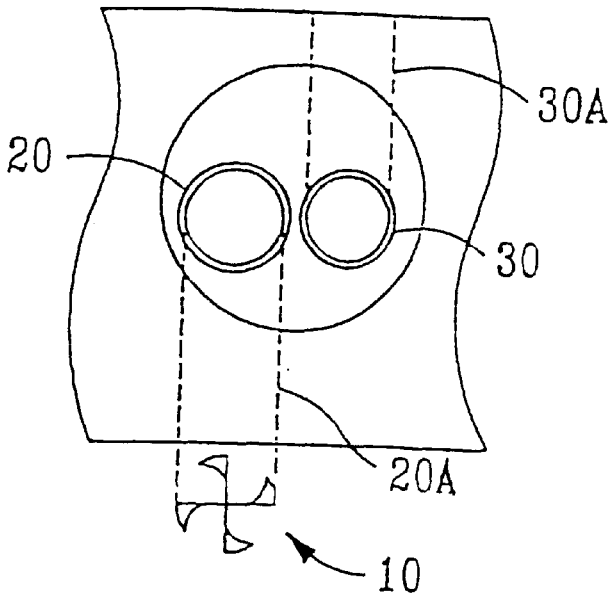
FIG. 2 shows the mounting position of the intake swirl enhancing structure of FIG. 1A in an intake manifold.
Figure 3:
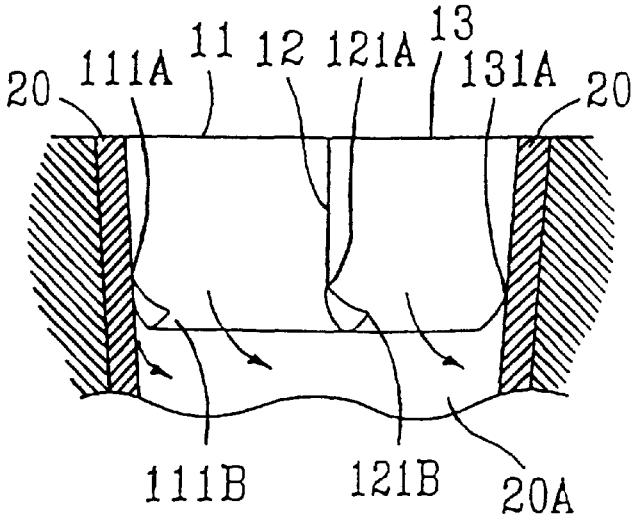
FIG. 3 shows the manner in which the intake swirl enhancing structure of FIG. 1A operates to swirl the intake.

FIG. 2 illustrates the installation position of the intake swirl enhancing structure 10 according to the first preferred embodiment of the present invention in an intake pipe. And, FIG. 3 illustrates the manner in which the intake swirl enhancing structure 10 in the first embodiment operates to swirl the intake. As shown, the intake swirl enhancing structure 10 is directly mounted in an intake port 20A. By taking advantage of the radial dimensional tolerance between the straight outer edges of the guide interfaces 11, 12, 13, and 14 and the inner diameter of the port 20A, or by taking advantage of the inclined outer edges of the guide interfaces 11, 12, 13, and 14, the intake swirl enhancing structure 10 can be well set in the inner wall surface 20 of the intake port 20A. Then, any parts of the intake port that were previously dismounted from the port for installing the intake swirl enhancing structure are mounted on the intake port again to complete the installation. After the intake swirl enhancing structure 10 is set in the intake port 20A that needs not any change in its design during the installation, the guide interfaces 11, 12, 13, and 14 cooperate with the port inner wall surface 20 to divide a space in the intake port 20A around the structure 10 and near the inlet end of the structure 10 into four sectors of gas passages. And, a space in the intake port 20A around the structure 10 and near the outlet end of the structure 10 is divided into four arcuated guide and compressing outlets. Whereby, when an automobile engine, for example, is started, a flow of intake passing the intake port having the structure 10 mounted thereto shall flow through four gas passages defined by the guide interfaces 11, 12, 13, 14 and the port inner wall surface 20 to split into four flows. After flowing through and out the arcuated outlets of the structure 10, the four flows combine to form a swirling turbulence and is supplied to the cylinder of the engine. This swirling turbulence results in increased intake-swirl ratio for the internal combustion engine, making the time of ignition delay shortened and the burning speed increased. The burning of fuel is more stable and the lean limit for the engine can be effectively increased. Therefore, the performance of the engine at middle to low load can be upgraded. Moreover, since the engine can operate at a lower fuel-air ratio, fuel consumption and air pollution caused by burning of fuel can be reduced. Since the intake swirl enhancing structure in the second preferred embodiment of the present invention has the same operating and working principle as that in the first embodiment, the intake swirl enhancing structure of the second embodiment is not repeatedly described herein.

Please now refer to FIGS. 4, 5 and 6 at the same time. FIG. 4 is a table showing basic specs of an engine under test for the purpose of the present invention. FIG. 5 is a table comparing the intake flow conditions of the tested engine before and after mounting the present invention. And, FIG. 6 is a graph showing the intake swirling strengths of the tested engine before and after mounting the present invention. From these figures, it can be seen that results from tests conducted under the same scientific testing conditions indicate the present invention indeed has the function of regulating an intake flow and producing turbulence that indeed enhances the swirling of the intake flow.

Figure 7:
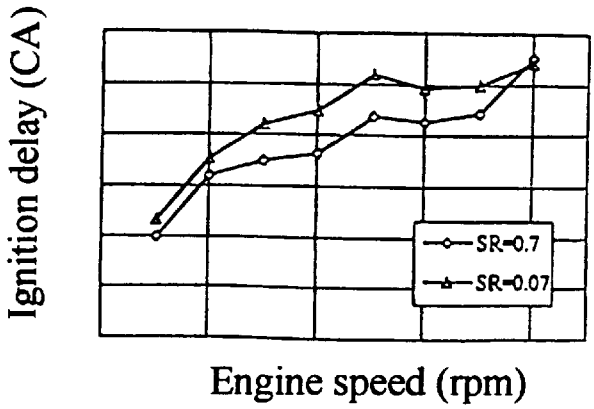
FIG. 7 is a graph showing ignition delays of the tested engine at different swirling strengths.
Figure 8:
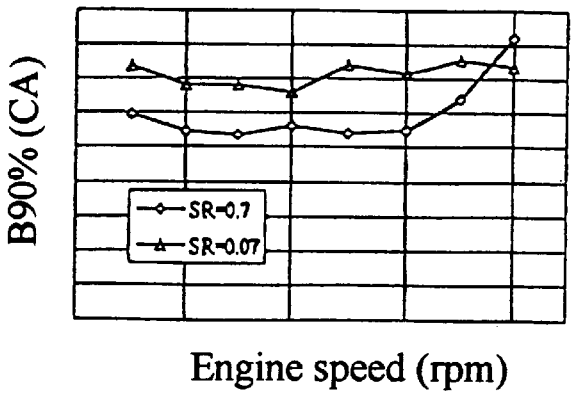
FIG. 8 is a graph showing the results from 5–90% burning time in the tested engine at different swirling strengths.
Figure 9:
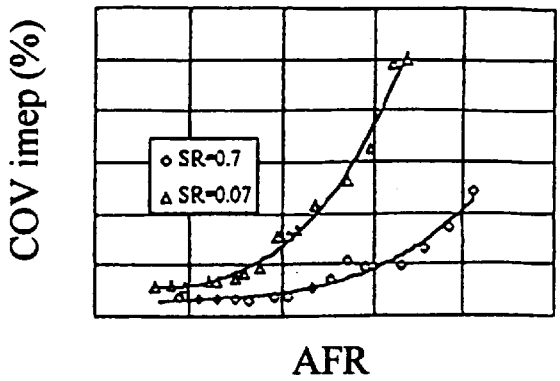
FIG. 9 is a graph showing the burning stability of the tested engine at different swirling strengths.
Figure 10:
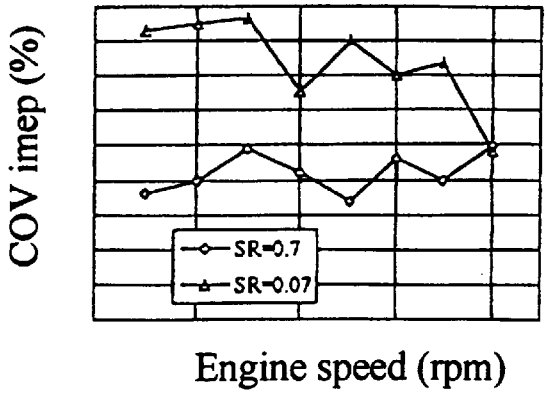
FIG. 10 is a graph showing the lean limits of the tested engine at different swirling strengths.

Please further refer to FIGS. 7 through 10. FIG. 7 is a graph showing ignition delays of the tested engine at different swirling strengths; FIG. 8 is a graph showing the results from 5–90% burning time of fuel in the tested engine at different swirling strengths; FIG. 9 is a graph showing the burning stability of fuel in the tested engine at different swirling strengths; and FIG. 10 is a graph showing the lean limits for the tested engine at different swirling strengths. As indicated by these figures, a tested two-valve engine that has been improved in its intake to induce in-cylinder swirls is found to have following results in its performance and burning stability:

1) Enhanced swirls result in shortened engine ignition delay and burning time and thereby increased thermal and mechanical efficiency.
2) Enhanced swirls result in increased indicated mean effective pressure (IMEP) and reduced cyclic variations, and thereby improve engine performance at partial load.
3) Enhanced swirls make the engine performance less sensitive to timing of engine and to air-fuel ratio setting, and thereby allow higher variation tolerance in mass production of engines and reduce engine manufacturing cost.
4) Enhanced swirls allow increased lean limit for the engine to operate with leaner mixture and thereby reduce fuel consumption and environmental pollution caused by fuel combustion.
5) Enhanced swirls are conducive to good performance of engine in full load at middle to low rotational speed.

From the above test results, it indicates that the installation of the present invention in an intake manifold can indeed improve the combustion of fuel in an engine in a very direct, simple, and economical way.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. An intake swirl enhancing structure for an internal combustion engine, the structure comprising a guide shaft and multiple guide interfaces radially extending from said guide shaft to equally divide a space surrounding said guide shaft into several intake passages, each of said guide interfaces being curved at an outer corner near an outlet end of said intake passages to form an arcuated guide surface portion, whereby a mixture of air and fuel passing an inlet end of said intake passage flows out said arcuated guide surface portion in the form of strong swirls which enter a cylinder of said internal combustion engine and combine into a turbulent swirl, and said intake swirl enhancing structure is adapted for mounting in an intake port of an engine of any type and said intake port may be an intake manifold, an intake port at a cylinder head, or a secondary port of any kind, or, said intake port may be a scavenging port of a two-stroke engine, or a secondary port of a rotary engine, or an intake passage of any other type of engine having an intake port.

2. An intake swirl enhancing structure for internal combustion engine as claimed in claim 1, wherein each of said guide interfaces has an overall configuration looking like a turbine.

3. An intake swirl enhancing structure for internal combustion engine as claimed in claim 1 or 2, wherein said guide interfaces are fixedly mounted about said guide shaft.

4. An intake swirl enhancing structure for internal combustion engine as claimed in claim 1 or 2, wherein said guide interfaces are pivotally mounted about said guide shaft.

5. An intake swirl enhancing structure for internal combustion engine as claimed in claim 1, wherein each of said guide interfaces has a vertical straight outer edge extending from an inlet end outer corner of each said guide interface to a point at where said arcuated guide surface portion begins, said intake swirl enhancing structure being installed in an intake port of said engine, said straight outer edges together defining a diameter for said intake swirl enhancing structure that is larger than an inner diameter of said intake port but with in an acceptable dimensional tolerance, whereby said intake swirl enhancing structure is set in said intake port with said vertical straight outer edges of said guide interfaces frictionally contacting with an inner wall surface of said intake port.

6. An intake swirl enhancing structure for internal combustion engine as claimed in claim 1, wherein each of said guide interfaces has a straight outer edge extending and inwardly inclining from an inlet end outer corner of each said guide interface to a point at where said arcuated guide surface portion begins, whereby said intake swirl enhancing structure can be easily set into an intake port of said engine.

7. An intake swirl enhancing structure for internal combustion engine as claimed in claim 1, wherein said arcuated guide surface portions of said guide interfaces have a curvature that allows outer surfaces of said arcuated guide surface portions to locate on the same one circle.

8. An intake swirl enhancing structure for internal combustion engine as claimed in claim 1, wherein a cross section of said guide interfaces at said inlet end is an inclined surface or an arcuated surface.

9. An intake swirl enhancing structure for internal combustion engine as claimed in claim 1, wherein the number of said guide interfaces is an odd number.

10. An intake swirl enhancing structure for internal combustion engine as claimed in claim 1, wherein the number of said guide interfaces is an even number.

11. An intake swirl enhancing structure for internal combustion engine as claimed in claim 1, wherein each of said guide interfaces has an overall configuration looking like a blade.

12. An intake swirl enhancing structure for internal combustion engine as claimed in claim 1, wherein said intake swirl enhancing structure is fixed in a cylinder port or in an intake manifold.

* * * * *